US006406178B1

(12) United States Patent
Lüscher et al.

(10) Patent No.: US 6,406,178 B1
(45) Date of Patent: Jun. 18, 2002

(54) DEVICE FOR ASSEMBLING A COVER MADE OF HARD MATERIAL ON THE MIDDLE PART OF A WATCH

(75) Inventors: Denis Lüscher, Grenchen; Michael Bach, Biel; Fernand Vuillaume, Porrentruy; Eloi Vuillaume, Grandfontaine, all of (CH)

(73) Assignee: Montres Rado S.A., Lengnau (CH)

( * ) Notice: Subject to any disclaimer, the term of this patent is extended or adjusted under 35 U.S.C. 154(b) by 56 days.

(21) Appl. No.: 09/711,954

(22) Filed: Nov. 15, 2000

(30) Foreign Application Priority Data

Nov. 17, 1999 (SZ) ..... 2089/99

(51) Int. Cl.[7] ..... G04B 37/00; G04B 39/00

(52) U.S. Cl. ..... 368/286; 294/297

(58) Field of Search ..... 368/88, 283, 286, 368/294–296, 297, 298, 299, 300

(56) References Cited

U.S. PATENT DOCUMENTS 3,643,423 A 2/1972 Piquerez
4,034,552 A * 7/1977 Davidson ..... 368/280
4,740,935 A * 4/1988 Gogniat ..... 368/294
5,490,123 A 2/1996 Biver

FOREIGN PATENT DOCUMENTS

| | | |
|---|---|---|
| CH | 311861 | 2/1956 |
| CH | 667966 | 11/1988 |
| FR | 2231042 | 12/1974 |

* cited by examiner

*Primary Examiner*—Vit Miska
(74) *Attorney, Agent, or Firm*—Sughrue Mion, PLLC

(57) ABSTRACT

Watch case (1) closed by a crystal (3) and a back cover (2) delimiting with a casing ring (6), a space (9) for housing at least a movement (29), including a metal center (30) whose outer wall has a stair structure (31, 31*a*, 32, 32*a*, 33) complementary to the inner structure (21, 21*a*, 22, 22*a*, 23, 23*a*) of the cover (20) secured to said center (30) by means of at least two screws (14, 16) passing through it via holes (34, 36) to tighten clamps (15, 17) housed in radial hollows (25, 27) formed in a vertical wall (21*a*) of the cover (20), by compressing an elastomeric gasket (12) arranged between two horizontal surfaces (22, 32) of the stair structures, and whose thickness is sufficient to arrange clearances (41, 41*a*) at least between opposite surfaces respectively of the back cover (2) and the base (21) of the cover (20), and the vertical wall (31*a*) of the center (30) and the wall (21*a*) of the cover (20) joining the base (21).

8 Claims, 5 Drawing Sheets

DEVICE FOR ASSEMBLING A COVER MADE OF HARD MATERIAL ON THE MIDDLE PART OF A WATCH

The present invention concerns a device for assembling a cover or a cap made of hard material on the upper edge of the middle part of a watch case.

In a wristwatch case the visible parts, i.e. the crystal, the middle part and the cover are the parts most exposed to outside attacks, such as scratches, shocks, oxydation, etc. In high quality products, the non esthetic consequences of such attacks on the crystal are removed or reduced by using a sapphire glass the manufacture of which is difficult, but whose simple geometric shape does not involve complicated machining, For the other external parts, it has long been proposed to use a very hard material, such as a ceramic material. Such material has remarkable resistance to external attack, but has the drawback of still being sensitive to shocks and being very ill suited to very complex machining. For this reason, this hard material is most often used as an exterior part for a subjacent structure which is easier to machine and generally less expensive.

In order to secure the structure and exterior part to each other, the most obvious solution is bonding, as described for example in Swiss Patent No. 517 963 published on 29.02.1972. This document proposes, for a solid slightly machined cover, or for a thin coating, inserting a glue joint between the opposite surfaces. In order to obtain optimum cohesion, the surfaces must be sufficiently large and have excellent surface evenness, of the order of 3/100 which requires minute rectifying operations. It is clear that such assembly by bonding no longer allows the part made of hard material to be replaced in the event that a shock removes a chip thereof. This same drawback is found in a variant of the method proposed in Swiss Patent No. 506 826 consisting in arranging a space between the cover and a case element, then filling it with a cement forming product.

In order to allow such a cover of hard material to be dismantled and replaced, Swiss Patent No. 508 925 propose fixing the cover to an element of the case in a removable manner by providing two grooves facing each other between which a closed elastic ring is inserted which will be compressed during assembly. If the cross-section of the ring is too large, the cover is liable to be broken by forcing it during assembly: if, conversely, the cross-section is too small, the cover is liable to rotate around the middle part which may be inconvenient for the passage of the time-setting stem, or non esthetic if the cover is not perfectly circular.

In order to overcome the above drawback, Swiss Patent No. 568 040 propose arranging blind holes radially in the bottom flat face of the cover, filling these holes with a material which can easily be threaded, and screwing said cover onto an element of the middle part. The proposed solution allows replacement of said cover to be envisaged, if necessary, and provide better positioning relative to the two assembled elements, but such a construction is relatively complex and the blind holes undeniably weaken said cover.

Other constructions are more of less linked to those mentioned hereinbefore and have the same drawbacks.

The object of the present invention is thus to overcome the drawbacks of this prior art by providing a device for assembling a cover made of hard material onto the upper edge of the middle part of a watch case or onto a part secured thereto, said cover being able to be obtained with a smaller number of machining operations and being able to be easily replaced in the event of breakage.

The invention therefore concerns a removable device for assembling a cover made of hard material onto the upper edge of the middle part of a watch case closed by a crystal and a back cover delimiting with a casing ring, a space for housing at least a movement, characterised in that it includes a metal centre whose outer wall has a stair structure complementary to the inner structure of the cover secured to said centre by means of at least two screws passing through it via holes to tighten clamps housed in radial hollows formed in a vertical wall of the cover, by compressing an elastomeric gasket arranged between two horizontal surfaces of the stair structures, and whose thickness is sufficient to arranged clearances at least between opposite surfaces respectively of the back cover and the base of the cover, and the vertical wall of the centre and the wall of the cover joining the base.

The invention will be better understood by taking as an illustrative and non limiting example a device for assembling a ceramic cover on a wristwatch of oblong shape, with reference to the annexed drawings, in which.

Figure 1:
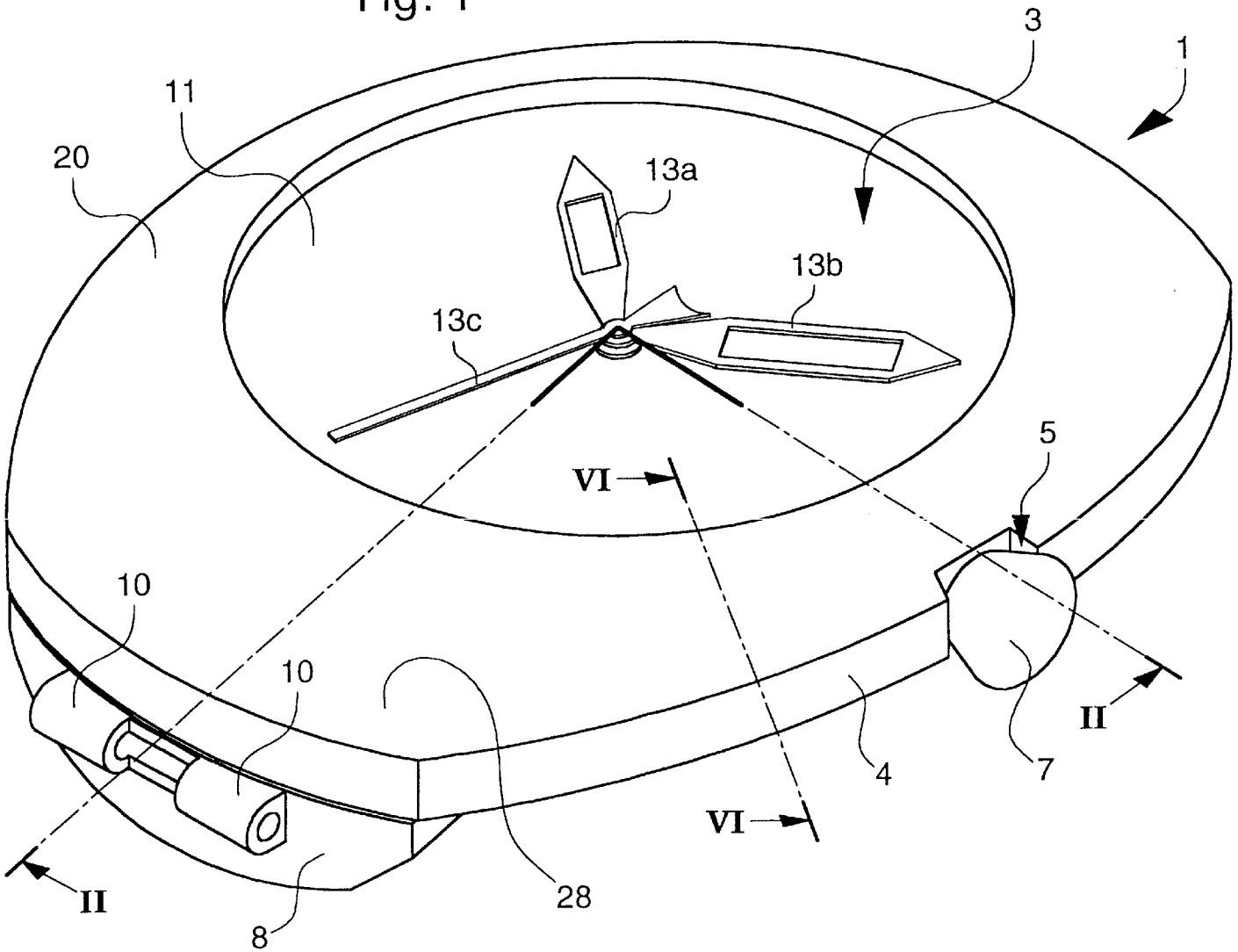
FIG. 1 is a perspective view.
Figure 2:
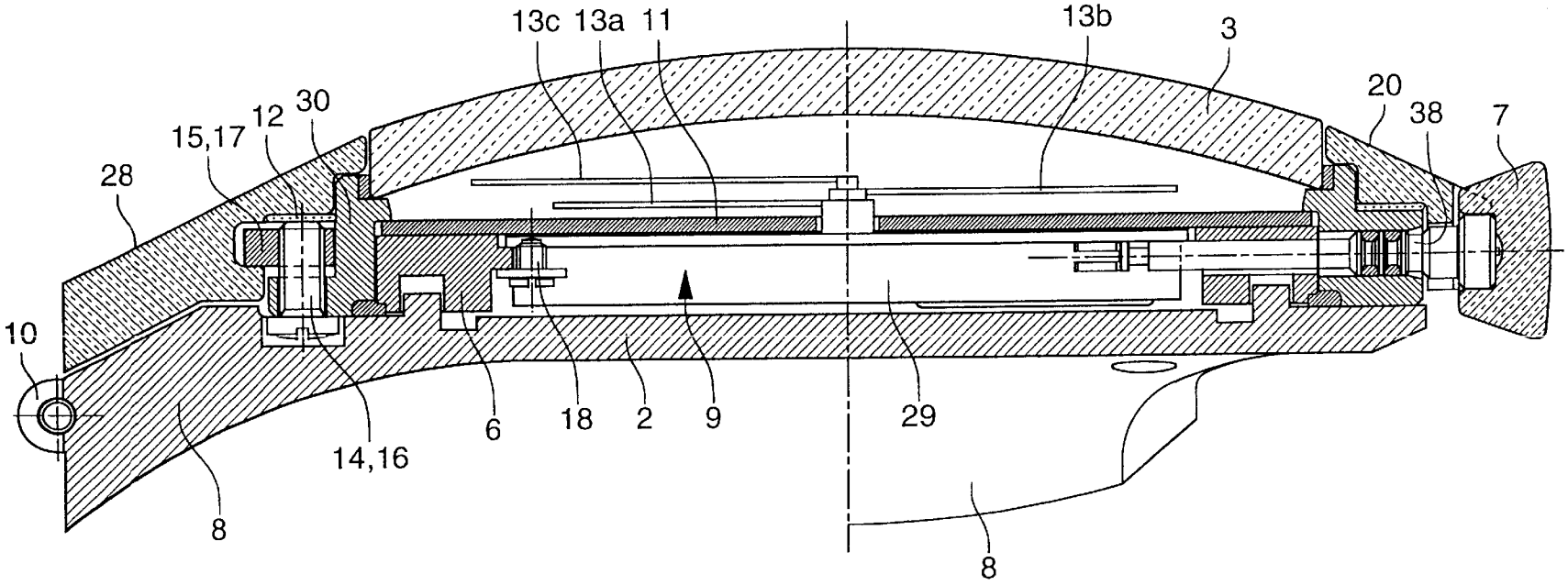
FIG. 2 is a cross-section along the broken line II—II of FIG. 1 passing through time positions 3 o'clock and 6 o'clock.

With reference to FIGS. 1 and 2, a wristwatch case 1 is shown the visible parts of which essentially comprise a cover 20 forming a middle part 4, in which a recess 5 is formed to house the time-setting crown 7. Recess 5 includes at its centre a notch 26, visible in FIG. 4, which joins the inner surface of cover 20 to allow the passage of the stem of time-setting crown 7. The central portion of cover 20 includes, above a dial 11 provided with hour/minute/second hands 13*a*, 13*b*, 13*c*, a sapphire crystal 3, the securing of which will be explained hereinafter. As is seen, cover 20 leaves visible, at the 12 o'clock-6 o'clock positions, below middle part 4, an extension 8 of back cover 2, curved outwards substantially along the curvature of a wrist and provided with horns 10 used for securing a wristband (not shown). It is clear that after a wristband has been secured, this extension 8 will no longer be visible at all.

Figure 3:
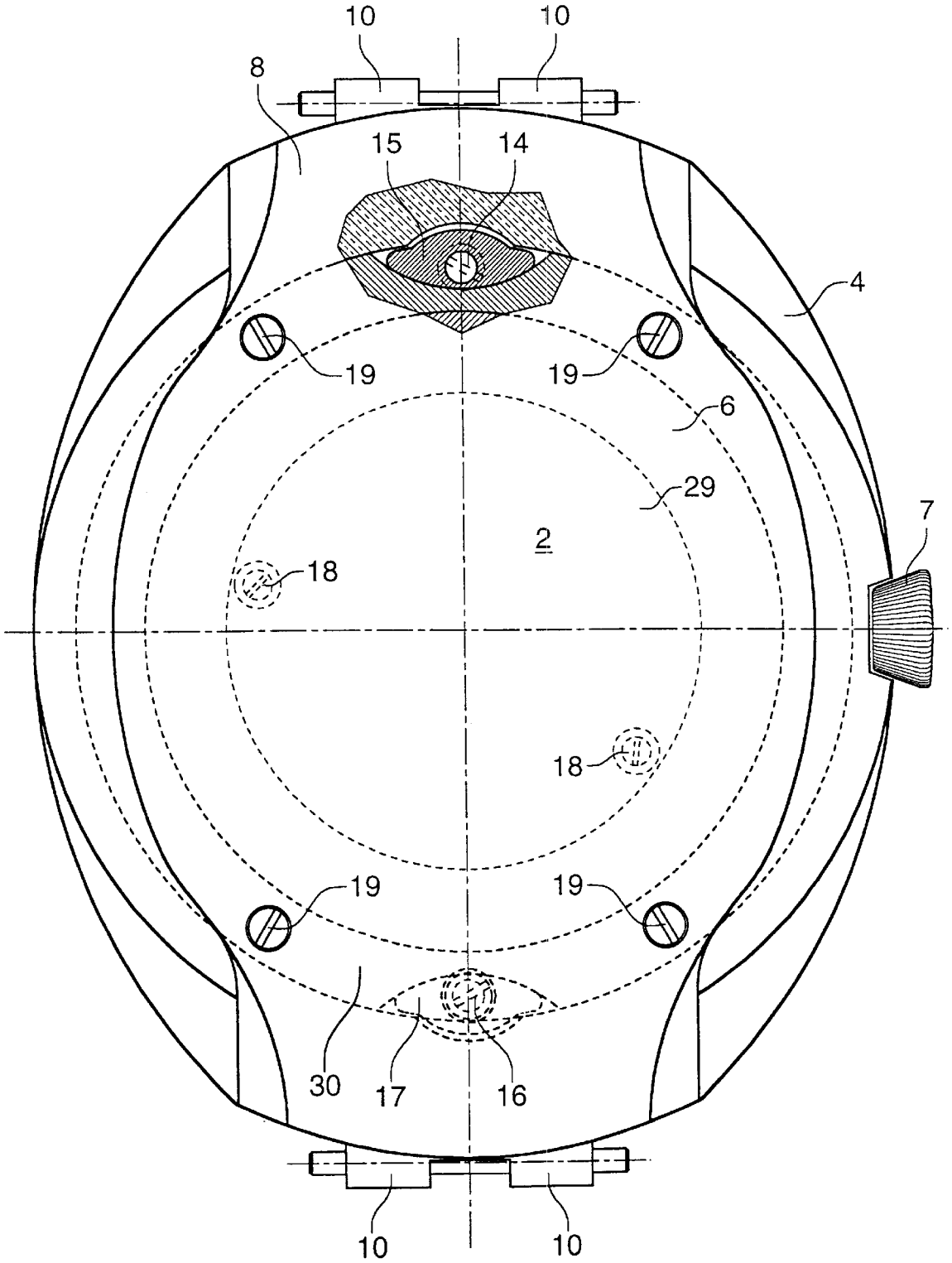
FIG. 3 is a bottom view of the wristwatch shown in FIG. 1, the back cover being partially torn away in the vicinity of a flange.

Back cover 2 and dial 11 delimit, with casing ring 6, a housing 9 for a clockwork movement 29 held by two fixing screws 18 (also visible in FIG. 3). Cover 20 has an oblong shape and covers, from the perimeter of crystal 3, the entire surface of the watch by forming two lugs 28 extending above extensions 8, and, like said extensions 8, curving outwards to form a dome.

Figure 4:
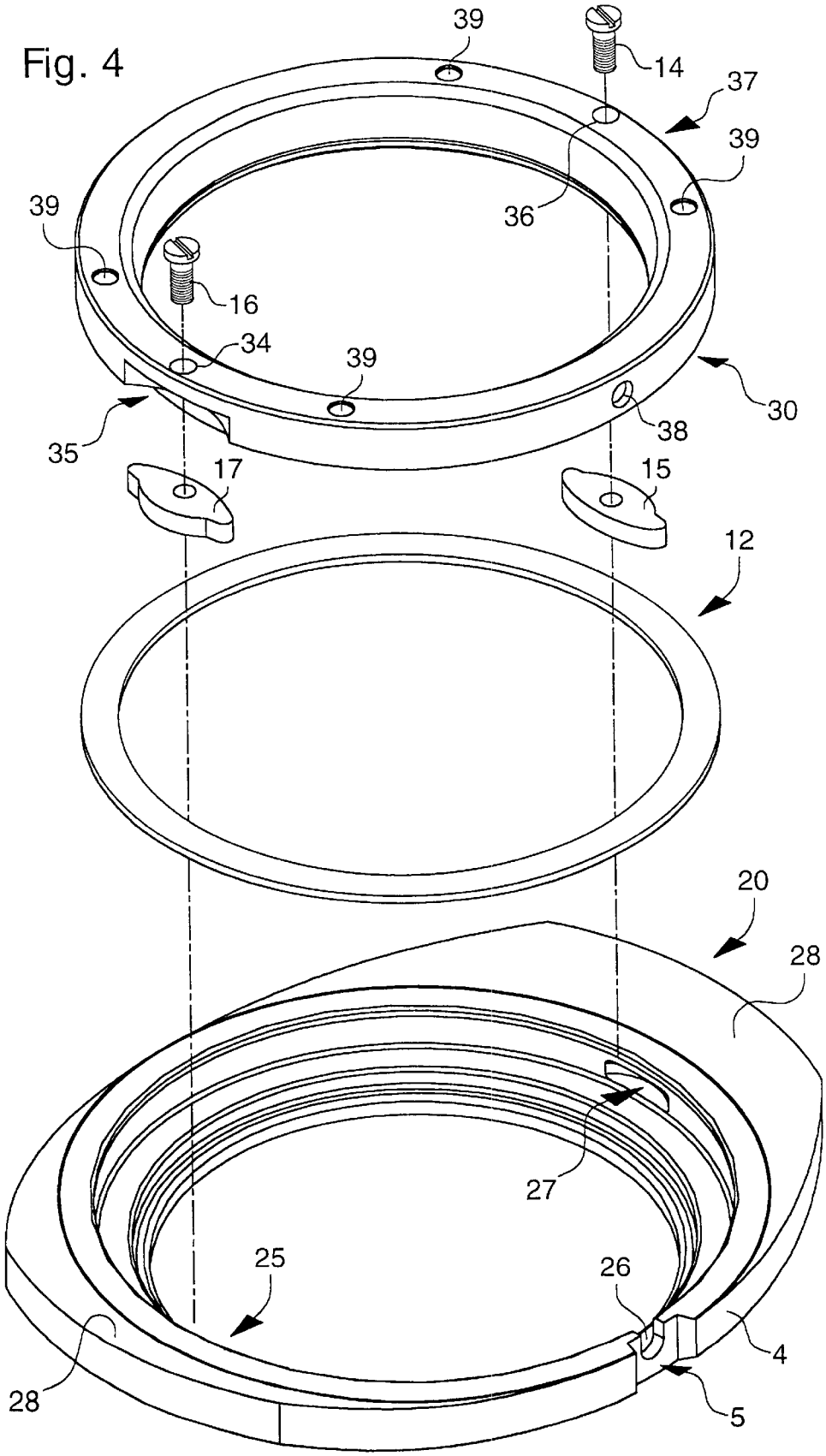
FIG. 4 is a blown up view of the assembling device.

FIG. 4 is a blown up perspective view of the assembling device, the different parts having the orientation of a bottom view as shown in FIG. 3. It can be seen that the device includes a metal centre 30, an elastomeric washer 12, two screws 14, 16 and two clamps 15, 17 which will allow cover 20 to be assembled.

Figure 6:
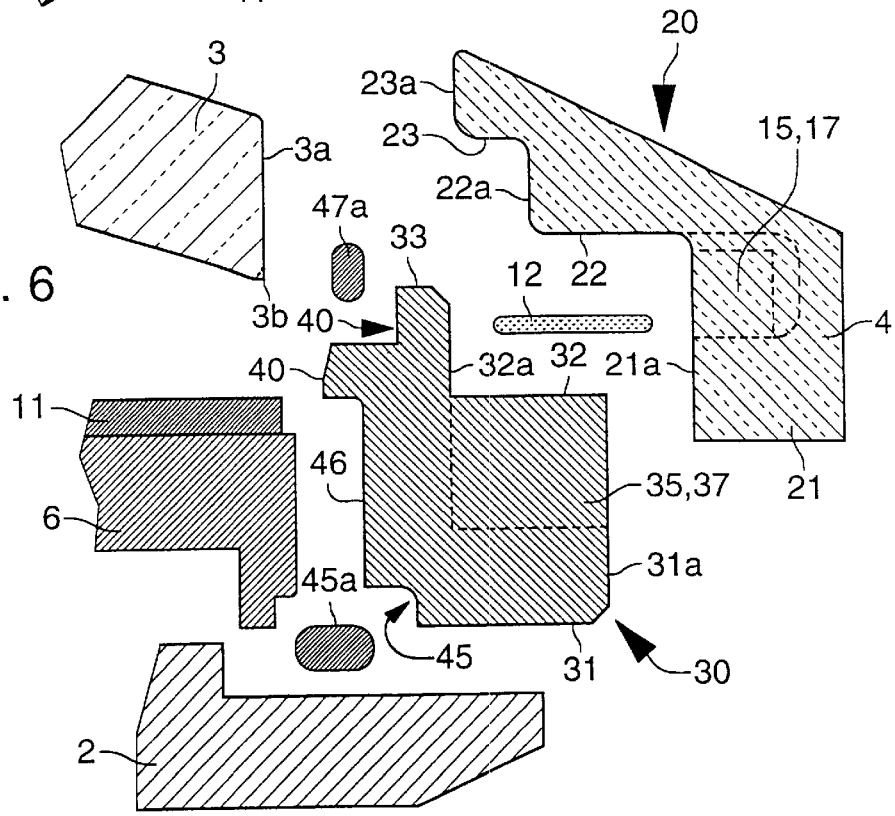
FIG. 6 is a blown up view of the cross-section along the line VI—VI of FIG. 1.

As shown on a larger scale in FIG. 6, the inner wall of the cover has an annular stair structure formed, from base 21, by orthogonal plane surfaces 21*a*, 22, 22*a*, 23*a*.

Figure 5:
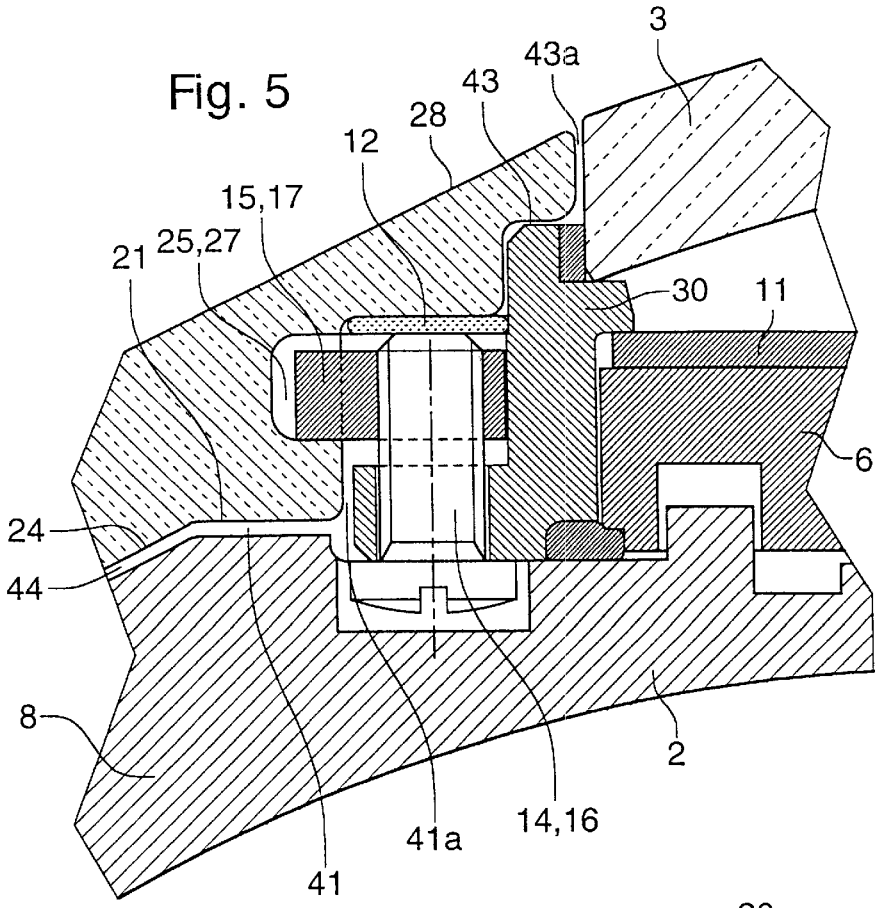
FIG. 5 is an enlarged view of the cross-section II—II at the 6 o'clock position.

As is seen in FIG. 5, base 21 is extended in the region of lugs 28 by oblique extensions 24 having the same angle of inclination as extensions 8 of back cover 2. The vertical portion 21*a*, joining base 21 and parallel to middle part 4, includes in the region of lugs 28 two diametrically opposite hollows 25, 27 intended to accommodate clamps 15, 17. With the exception of the polishing operations of the outer surfaces, these hollows are the only parts of cover 20 which require any particular machining. They may for example be obtained by means of diamond wheel grinding, or by providing, during manufacturing of the cover, drawers in the mould at the locations of hollows 25, 27.

Metal centre 30 is formed of a ring whose outer surface has a stair shape, complementary to that of cover 20, formed, from base 31, by plane surfaces 31*a*, 32, 32*a*, 33. The inner wall 46 of metal centre 30 includes at its base and on its top part two annular grooves 45, 47 for accommodating sealing gaskets 45*a*, 47*a* compressed respectively axially against back cover 2 and radially against vertical edge 3*a* of crystal 3. The bottom of annular groove 47 is extended towards the interior of case 1 by a ring 40 which will form a flange between beak 3b of crystal 3 and dial 11. It is clear that this ring 40 is only of an optional nature and that it could be replaced by an independent flange.

With reference more particularly to FIGS. 4 and 5, it can be seen that surface 33 of metal centre 30 includes two diametrically opposite open recesses 35, 37 intended to accommodate clamps 15, 17. Recesses 35, 37 include in their substantially median portion the axial holes 34, 36 in which screws 14, 16 for fixing clamps 15, 17 will be engaged. These recesses 35, 37 allow the height of the assembling device to be reduced and facilitate the positioning of centre 30 above the clamps. According to a simpler embodiment, it is also possible not to provide any recesses. Metal centre 30 includes finally, distributed over its periphery, four threaded holes 39 for securing back cover 2 by means of four screws 19, and a radial hole 38 for the passage of the stem of crown 7.

As is seen, all the machining operations, which would be difficult, or impossible to perform on an extra hard material can easily be performed on a ring of initially rectangular cross-section for example made of steel or brass.

With reference more particularly to FIGS. 4 to 6 it will be explained hereinafter how the device according to the invention makes the assembly or dismantling of cover 20 very easy.

In a first step, from the central element formed by metal centre 30, it is possible to pre-assemble all the constituent elements of the watch in a known manner, crystal 3, hands 13*a*, 13*b*, 13*c*, dial 11, casing ring 6, movement 29 and crown 7, with the exception of cover 20 and back cover 2. It will also be observed that, in the event that ring 40 is replaced by an independent flange, metal centre 30 and casing ring 6 may also be made in a single piece.

Elastomeric washer 12 is then set in place on annular surface 22 of the stair structure of cover 20, then the two clamps 15, 17 are engaged in hollows 25, 27. Next, metal centre 30 is set in place by positioning recesses 35, 37 above clamps 15, 17, then the assembly is screwed together by means of screws 14, 16 so as to compress washer 12 between the opposite annular surfaces 22, 32 of cover 20 and metal centre 30, and finally the back cover is screwed on by means of four screws 19.

As is seen in FIG. 5, the side of the assembled elements and the thickness of elastomeric washer 12 are provided so that there are very slight clearances between the inner surfaces of cover 20 and the surfaces of the elements facing each other, with the exception of surfaces 22, 32 between which elastomeric washer 12 is compressed. The clearance between oblique extension 24 and extension 8 of back cover 2 is designated by the reference 44, that between base 21 and back cover 2 by the reference 41, that between wall 21*a* and corresponding wall 31*a* of centre 30 by the reference 41*a*, that between wall 23 and external edge 33 of center 20 by the reference 43 and that between wall 23*a* and edge 3*a* of crystal 3 by the reference 43*a*. The clearance between wall 22*a* and corresponding surface 32*a* of the centre is practically non existent so that it is no longer correct to say that there is a push fit at that location. These clearances have been deliberately provided to allow cover 20 to swing slightly in the event of a slight shock and thus to avoid breaking it. If the shock is too great, and causes irreversible damage to cover 20, it will be very easy to replace it by removing back cover 2 and unscrewing the two screws 14, 16.

In the example shown, the means for securing the cover are two in number and are positioned under back cover 2 at the 12 o'clock-6 o'clock positions, on the cover where there is the most material. By comparing the cross-sections of FIGS. 5 and 6 it will be observed that the point of hollows 25, 26 closest to the surface of cover 20 remains the same over the entire periphery of said cover, so that, according to an alternative embodiment, one may envisage using more than two securing means occupying different angular positions with respect to the 12 o'clock-6 o'clock axis. In the embodiment taken by way of example, it will be observed that the two axial holes 34, 36 and the four threaded holes 39 are offset angularly, i.e. they are distinct and only the screws 19 for securing back cover 2 are visible. According to an alternative embodiment which is not shown, centre 30 includes only two threaded holes 39 for two screws 19 for securing the back cover, the two other screws being the same as screws 14, 16 for securing clamps 15, 17 with longer stems. With respect to the assembling/dismantling process described above, this embodiment has the advantage of being able to replace cover 20 without removing back cover 2 and thus without risking damaging sealing gasket 45*a*.

The example which has just been described concerns a dial of circular shape with an oblong cover, but it is clear that, without departing from the scope of the present invention, those skilled in the art may adapt this securing device to any type of cover and to any type of dial.

What is claimed is:

1. A removable device for assembling a cover made of hard material onto the upper portion of the middle part of a watch case closed by a crystal and a back cover delimited with a casing ring, said watch case including a space for housing at least a movement, said device comprising a metal center with an outer wall having a stair structure complementary to the inner structure of said cover made of hard material, said metal center secured to said cover by means of at least two screws passing through holes in said center, said cover including radial hollows formed in a vertical wall thereof and housing clamps tightened by said screws, an elastomeric gasket arranged between two horizontal surfaces of the stair structures of said metal center and said cover, the thickness of elements of the device and the gasket being sufficient to arrange clearances at least between opposite surfaces respectively, of the back cover and the base of the cover made of hard material, and a vertical wall of the center and a wall of the cover joining the base.

2. A device according to claim 1, wherein the center further includes recesses open towards the cover at the locations of the clamps and having as depth substantially the thickness of said clamps.

3. A device according to claim 1, wherein the center further includes threaded holes offset angularly with respect to the holes for the clamps screws and allowing the back cover to be secured by means of screws.

4. A device according to claim 3, wherein two screws for securing the clamps also allow the back cover to be secured.

5. A device according to claim 1, wherein the cover has an oblong shape and includes two hollows positioned at 12 o'clock and 6 o'clock.

6. A device according to claim 1, wherein the inner edges of the center further include two grooves intended to accommodate two gaskets assuring sealing with the back cover and the crystal.

7. A device according to claim 1, wherein the top portion of the inner wall of the center includes an annular extension forming a flange.

8. A device according to claim 1, wherein the center and the casing ring are made in a single piece.

* * * * *